US010886611B2

(12) United States Patent
Di Paola et al.

(10) Patent No.: US 10,886,611 B2
(45) Date of Patent: Jan. 5, 2021

(54) HYBRID HIGH GAIN ANTENNA SYSTEMS, DEVICES, AND METHODS

(71) Applicant: wiSpry, Inc., Irvine, CA (US)

(72) Inventors: Carla Di Paola, Aalborg (DK); Shuai Zhang, Aalborg SV (DK); Gert Frølund Pedersen, Storvorde (DK)

(73) Assignee: WISPRY, INC., Irvine, CA (US)

( * ) Notice: Subject to any disclaimer, the term of this patent is extended or adjusted under 35 U.S.C. 154(b) by 58 days.

(21) Appl. No.: 16/240,399

(22) Filed: Jan. 4, 2019

(65) Prior Publication Data

US 2019/0214722 A1 Jul. 11, 2019

Related U.S. Application Data

(60) Provisional application No. 62/614,092, filed on Jan. 5, 2018.

(51) Int. Cl.

| | |
|---|---|
| ***H01Q 3/24*** | (2006.01) |
| ***H01Q 19/30*** | (2006.01) |
| ***H01Q 1/24*** | (2006.01) |

(52) U.S. Cl.

CPC ..... *H01Q 3/24* (2013.01); *H01Q 1/243* (2013.01); *H01Q 19/30* (2013.01)

(58) Field of Classification Search

CPC .. H01Q 3/24; H01Q 3/247; H01Q 1/241–243; H01Q 19/28; H01Q 19/30

See application file for complete search history.

(56) References Cited

U.S. PATENT DOCUMENTS

| | | | | |
|---|---|---|---|---|
| 5,959,578 | A * | 9/1999 | Kreutel, Jr. | H01Q 3/26 342/154 |
| 6,061,035 | A * | 5/2000 | Kinasewitz | H01Q 3/22 343/700 MS |
| 6,876,331 | B2 * | 4/2005 | Chiang | H01Q 1/242 343/702 |

(Continued)

FOREIGN PATENT DOCUMENTS

| | | | |
|---|---|---|---|
| CN | 107403996 | A | 11/2017 |
| JP | H11-112230 | A | 4/1999 |

(Continued)

OTHER PUBLICATIONS

International Search Report and Written Opinion for Application No. PCT/US2019/012379 dated Apr. 29, 2019.

(Continued)

*Primary Examiner* — Jason Crawford

(74) *Attorney, Agent, or Firm* — Jenkins, Wilson, Taylor & Hunt, P.A.

(57) ABSTRACT

Devices, systems, and methods for a hybrid high gain antenna in which a plurality of antennas are mounted substantially symmetrically such that the antennas collectively provide 180° of antenna coverage for a surface above the antennas. In some embodiments, the hybrid high gain antenna system can be mounted on a mobile device with sufficient inclinations such that the antennas collectively provide approximately 180° of antenna coverage. In some embodiments, the hybrid high gain antenna system is configured to reach a gain of between about 10 dBi and 12 dBi at a target frequency of between about 26 GHz and 30 GHz.

32 Claims, 12 Drawing Sheets

(56) References Cited

U.S. PATENT DOCUMENTS

| | | | | |
|---|---|---|---|---|
| 7,224,321 | B2 * | 5/2007 | Chiang | H01Q 1/242 343/700 MS |
| 7,403,160 | B2 * | 7/2008 | Chiang | H01Q 9/36 343/702 |
| 7,605,768 | B2 * | 10/2009 | Ebling | H01Q 1/3233 343/700 MS |
| 9,711,849 | B1 * | 7/2017 | Chen | H01Q 3/247 |
| 2002/0036595 | A1 * | 3/2002 | Chiang | H01Q 21/205 343/876 |
| 2005/0219126 | A1 * | 10/2005 | Rebeiz | H01Q 3/242 343/700 MS |
| 2007/0159404 | A1 * | 7/2007 | Gilmore | H01Q 19/30 343/702 |
| 2013/0241800 | A1 * | 9/2013 | Schlub | H01Q 21/29 343/893 |
| 2014/0361946 | A1 * | 12/2014 | Ganchrow | H01Q 19/30 343/795 |
| 2015/0194736 | A1 * | 7/2015 | Diukman | H01Q 21/0006 343/818 |
| 2018/0241135 | A1 * | 8/2018 | Furlan | H01Q 21/0006 |
| 2018/0287693 | A1 * | 10/2018 | Naseef | H04B 7/18513 |
| 2019/0379119 | A1 * | 12/2019 | He | H01Q 25/00 |

FOREIGN PATENT DOCUMENTS

| | | | |
|---|---|---|---|
| JP | 2005/260603 | A | 9/2005 |
| WO | WO 2017/156901 | A1 | 9/2017 |
| WO | WO 2019/136271 | A1 | 7/2019 |

OTHER PUBLICATIONS

Alhalabi et al., "High-gain Yagi-Uda antennas for millimeter-wave switched-beam systems," IEEE Transactions on Antennas and Propagation, vol. 57, No. 11, pp. 3672-3676 (2009).

* cited by examiner

HYBRID HIGH GAIN ANTENNA SYSTEMS, DEVICES, AND METHODS

CROSS-REFERENCE TO RELATED APPLICATION

The present application claims priority to U.S. Provisional Patent Application Ser. No. 62/614,092, filed on Jan. 5, 2018, the entire disclosure of which is incorporated by reference herein.

TECHNICAL FIELD

The subject matter disclosed herein relates generally to antenna systems and devices. More particularly, the subject matter disclosed herein relates to antenna configurations for mobile devices having multiple antennas.

BACKGROUND

The fifth generation mobile communications network, also known as 5G, is expected to provide significant improvements in data transmission rates, reliability, and delay, as compared to the current fourth generation (4G) communications network Long Term Evolution (LTE). Furthermore, new generation mobile phones are expected to eventually have antenna clearances of only about 5 mm. This could potentially put significant constraints on future mobile devices, possibly limiting the gain of antenna systems in the mobile devices due to the short space available for placing the antennas inside the mobile devices.

Therefore, there is a need for compact antennas that meet both the technical demands (higher data rates) of the 5G communications network and also fit within the confines of the 5 mm clearance available in most new generation mobile phones.

SUMMARY

In accordance with this disclosure, devices, systems, and methods for producing a hybrid high gain antenna system at least at 28 GHz for, for example without limitation, 5G mobile devices are provided. The design of the present subject matter exploits hybrid high gain antennas, placed in the clearance of a mobile device and points the antennas in different directions, to cover a surface of approximately 180 degrees (180°). In one aspect, a mobile device is provided comprising: a first plurality of antennas in a first clearance space of the mobile device, wherein each antenna of the first plurality of antennas is oriented to provide a respective subset of antenna coverage for a first device surface over the first clearance space; wherein the first plurality of antennas is configured to collectively provide antenna coverage for the first device surface over the first clearance space of the mobile device; and wherein the first plurality of antennas is arranged in the first clearance space substantially symmetrically with respect to a longitudinal center line of the mobile device. At least some of the antenna systems and devices of the present disclosure are wideband, large coverage antennas with high-gain at all of the relevant frequencies of operation.

In another aspect, each antenna of the first plurality of antennas is configured, by virtue of having a respective beamwidth and orientation, to provide a subset of approximately 180° of antenna coverage for the first device surface over the first clearance space.

Some advantages offered by the subject matter disclosed herein include that every single antenna used in the present subject matter is independent from other antennas in the system and they are not part of an array. Thus, there is less of a constraint with regard to the distance each of the antennas can be spaced apart with respect to one another. Additionally, different types of antennas can be used, not just the Yagi-Uda design used hereinbelow for simulations. Finally, a significant advantage introduced by the present subject matter is the fact that there is no need for a phase shifter to steer the antenna beam and obtain a desired coverage.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present disclosure describes mobile devices and antenna systems for mobile devices for the upcoming 5G wireless communications networks. In some embodiments, the systems use hybrid high gain antennas, placed in the clearance of the mobile device and pointed in different directions (e.g., to cover a range of about 180°). In such an embodiment, each antenna positioned in the clearance of the mobile device is configured to cover a discrete subset of the entire approximately 180° beamwidth operating range. That is, there is an adequate number of antennas, with the same or different individual beam widths, and the antennas are spaced apart adequately to cover an aggregate angular range that is greater than the angular coverage of any one antenna, such as to cover a total beamwidth of 180°. In some embodiments, each antenna is configured to cover the same range, for example without limitation 45°. In such an embodiment, 4 discrete antennas would be required to cover the 180° operating range because every two antennas would cover 90°.

In some embodiments, each discrete antenna is configured to cover a different beamwidth range, for example without limitation, one or more antennas configured to cover 45° and one or more antennas configured to cover 30°. In some embodiments, when the operating range of each discrete antenna is 30°, then six antennas would be required since the six antenna's operating range combined would equal about 180°. Therefore, in some embodiments, each antenna can be configured with a 30° beamwidth, and each antenna can be configured to reach a gain in the range of between about 10 and 12 dBi. Furthermore, in some embodiments, the mobile device can comprise an odd number of antenna elements, wherein one of the antenna elements is mounted in the center of the clearance space and the remaining antenna elements are arranged symmetrically about the central antenna. The clearance of new generation mobile phones is only 5 mm high in some cases, a significant constraint, which can limit the gain of each component. The subject matter disclosed herein includes some possible solutions that attempt to address throughput and data rate needs of future 5G wireless networks given the 5 mm clearance constraints.

Figure 1:
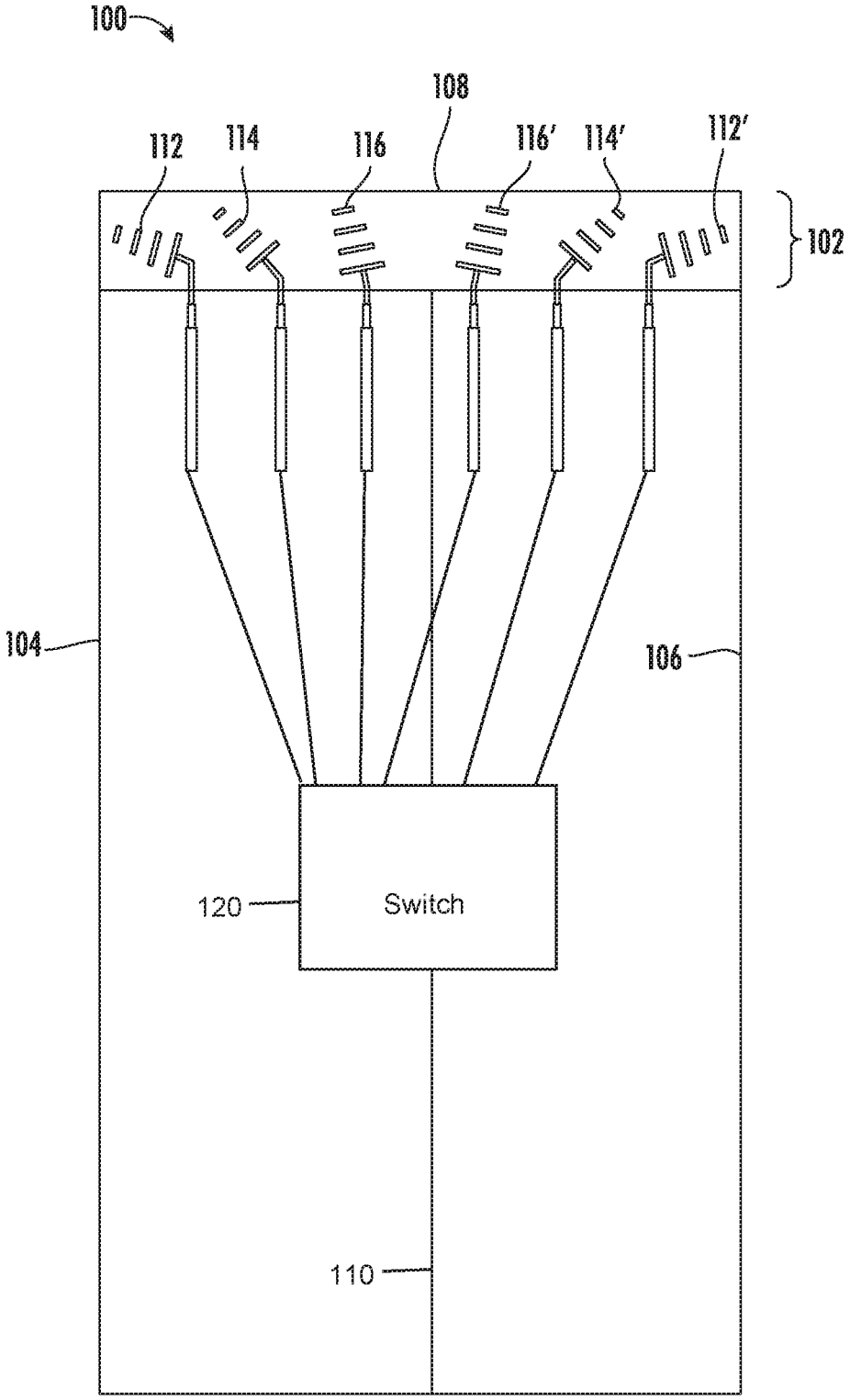
FIG. 1 illustrates a front view of an example mobile device comprising an example antenna system of the present disclosure.

FIG. 1 illustrates a front view of an example mobile device 100. The mobile device 100 includes a clearance space 102, a left longitudinal side 104, and a right longitudinal side 106. The mobile device 100 includes a device surface 108 over the clearance space 102. In some embodiments, the mobile device 100 includes an antenna system using, for example without limitation, a plurality of high gain Quasi-Yagi antennas, such as, for example without limitation, those described in Alhalabi, Ramadan A., and Gabriel M. Rebeiz. "High-gain Yagi-Uda antennas for millimeter-wave switched-beam systems." IEEE Transactions on Antennas and Propagation 57.11 (2009): 3672-3676, which is hereby incorporated by reference in its entirety. Generally, Yagi-Uda antennas have moderate to high gain and radiation patterns that are relatively unidirectional (e.g., radiation patterns having a unidirectional end-fire shape). These features make Yagi-Uda or Quasi-Yagi antennas ideal for use in some embodiments of the present disclosure. That being said, the present subject matter is not limited to the use of Yagi-Uda antennas or the like, but rather can also be implemented using any of a variety of other types of high gain antennas.

In some embodiments, the mobile device 100 includes a first set of antennas, first antenna 112, second antenna 114, and third antenna 116, mounted in the left-half side of the clearance space 102. In some embodiments, the mobile device 100 also includes a second set of antennas, fourth antenna 116', fifth antenna 114', and sixth antenna 112', mounted in the right-half side of the clearance space 102. The first antenna 112, second antenna 114, and third antenna 116 are mounted in order from the left longitudinal side 104 to a longitudinal center line 110 of the mobile device 100, and the fourth antenna 116', fifth antenna 114', and sixth antenna 112' are mounted in the same order from the right longitudinal side 106 to the longitudinal center line 110. As a result, the first set of antennas including first antenna 112, second antenna 114, and third antenna 116, and the second sets of antennas including fourth antenna 116', fifth antenna 114', and sixth antenna 112' are arranged substantially symmetrically about the longitudinal center line. Although the illustrated embodiment includes three antenna elements on each half of the clearance space, those having ordinary skill in the art will appreciate that different numbers of antenna can be used to achieve a distribution of the antenna coverage. For example, a greater number of elements can be used in some embodiments, with each antenna providing a comparatively narrower beam than the configuration discussed above. Such use of additional antenna elements can be used to achieve a higher gain.

In general, first antenna 112, second antenna 114, and third antenna 116 are three different antennas, and the antennas can be placed as appropriate for the design of the mobile device 100. Typically, first antenna 112, from the first set of antennas, has the same beamwidth as sixth antenna 112', from the second set of antennas, and an opposite orientation. Similarly, second antenna 114, from the first set of antennas, has the same beamwidth as fifth antenna 114', from the second set of antennas, and an opposite orientation. Finally, third antenna 116, from the first set of antennas, has the same beamwidth as fourth antenna 116', from the second set of antennas, and an opposite orientation. The first and second sets of antennas are configured to collectively provide antenna coverage for the device surface 108 over the clearance space 102 of the mobile device 100 (e.g., over a range of about 180°).

In some embodiments, to achieve such collective antenna coverage over the clearance space 102, the plurality of antennas can be positioned and/or oriented at different angles so that each antenna provides high-gain coverage over a different portion of the total coverage area. Or in other words, the plurality of antennas can be positioned and/or oriented at different angles so that each antenna provides a subset of 90° of antenna coverage for the device surface 108 over the second half of the clearance space 102 of the mobile device 100. In some embodiments, for example without limitation, each antenna can have a 30° beamwidth and high gain at desired frequencies for 5G operation (e.g., at about 28 GHz). For example and without limitation, in some embodiments, the first antenna 112 is configured to scan between about 0° and 30°, second antenna 114 is configured to scan between about 30° and 60°, third antenna 116 is configured to scan between about 60° and 90°. Furthermore, fourth antenna 116' is configured to scan between about 60° and 90° as well, but in the opposite direction as third antenna 116. Fifth antenna 114' is configured to scan between about 30° and 60° as well, but in the opposite direction as second antenna 114. Finally, sixth antenna 112' is configured to scan between about 0° and 30° as well, but in the opposite direction of first antenna 112. In combination, first antenna 112, second antenna 114, third antenna 116, fourth antenna 116', fifth antenna 114', and sixth antenna 112' collectively are capable of scanning the device surface 108 of about 180°. Compared to some conventional antenna systems, the antenna system of the mobile device 100 can provide a series of advantages. For example, different antennas can be used, even if in the simulated design Yagi-Uda antennas with different inclination have been exploited. In addition, in some embodiments, there is no need for a phase shifter to steer the beam to obtain the coverage.

In some embodiments, the mobile device 100 comprises a feeding network (not shown) for the antennas. In some embodiments, the feeding network comprises a power supply and a switch 120. These elements make the structure more reliable and less lossy. Furthermore, as discussed hereinabove, the antenna system does not require phase shifters to steer the beam and obtain the coverage, but by simply switching the feeding to one of the elements, first antenna 112, second antenna 114, third antenna 116, fourth antenna 116', fifth antenna 114', and sixth antenna 112', it is possible to scan the desired areas. The absence of phase shifters to scan the beam overcomes the dependence of the frequency to the phase, allowing the desired coverage in the whole bandwidth, without any additional components.

Furthermore, in some embodiments, every single antenna is substantially independent from the other antennas (i.e., substantially zero coupling between antenna elements) and they are not part of an array. In such embodiments, there is less of a constraint about the distance between two adjacent elements. That being said, the disclosed antenna systems are still operable in embodiments in which the design of the individual antennas and the spacing/arrangement of the antennas affects the mutual coupling of the antennas. Mutual coupling is typically undesirable because radiating energy that should be radiated outward or away from the radiating antenna is absorbed by a nearby antenna. Similarly, energy that could be absorbed by one antenna is actually absorbed by another nearby antenna. Therefore, in some embodiments of the present disclosure, it is ideal to design the spacing of the antennas such that mutual coupling is managed properly.

Figure 2:
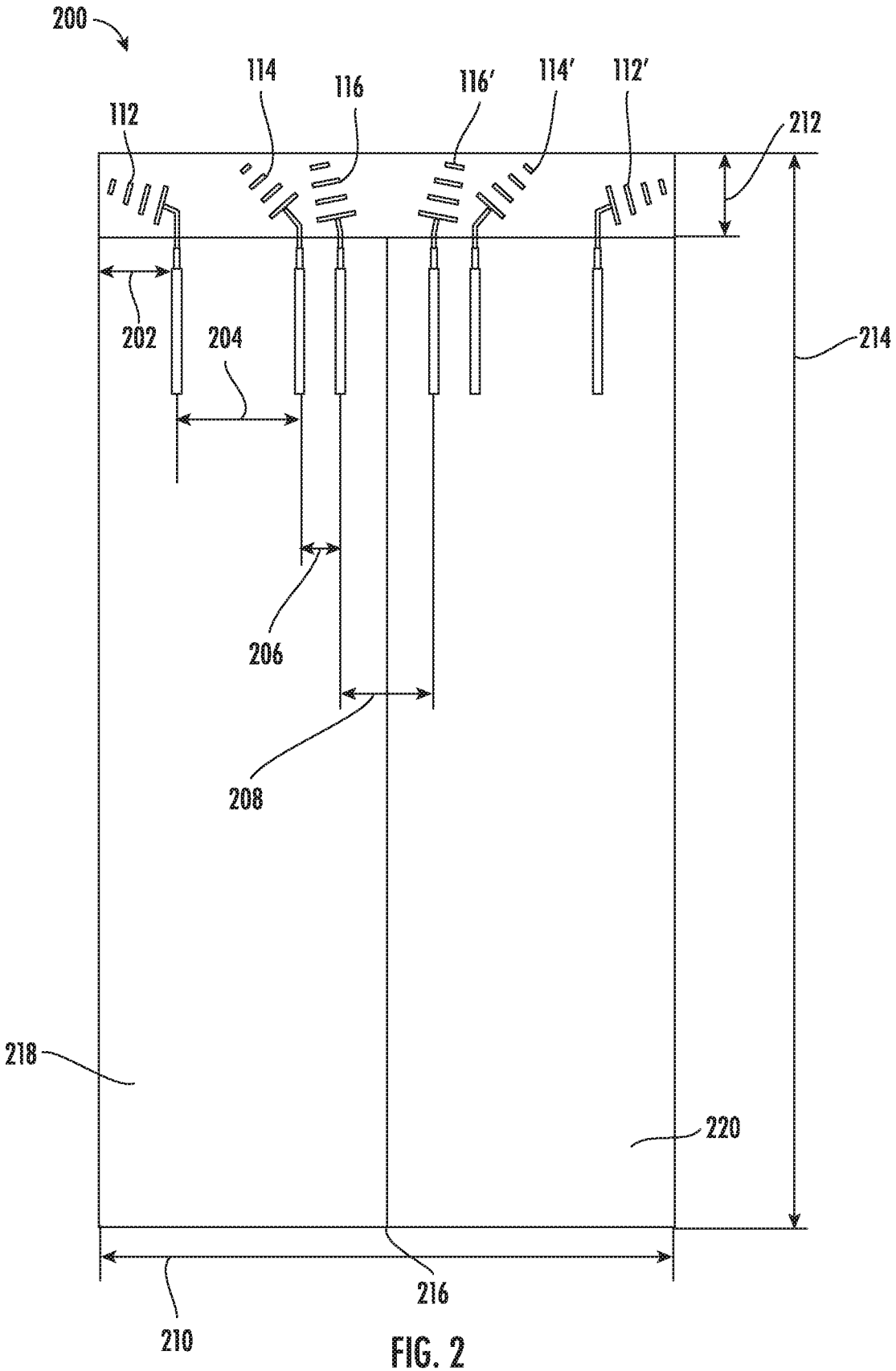
FIG. 2 illustrates a simulated antenna system on a substrate.

To illustrate a possible design, consider the example simulated antenna system 200 illustrated in FIG. 2 using high gain Quasi-Yagi antennas. The antennas are built on both sides of the substrate 216 and use the ground plane of the substrate 216 as a reflector. As discussed above, the spacing and/or arrangement of the antennas can be designed to manage mutual coupling between elements where present. In general, with respect to antenna designs, coupling can be reduced by increasing the inter-antenna distance, using isolation enhancement techniques, or making the antenna beam in the steering plane narrower.

In the configuration illustrated in FIG. 2, for example, the internal antenna pairs (i.e., second antenna 114 and third antenna 116, and fourth antenna 116' and fifth antenna 114') are positioned closer to one another than they are to the edge elements (i.e., first antenna 112 and sixth antenna 112') to manage coupling. This coupling management can be balanced against optimum antenna placement for collective coverage. Similarly in this regard, the type of antenna element used can be selected (e.g., to be different than the Quasi-Yagi antennas discussed above) to change the effect of spacing and arrangement on the mutual coupling between antenna elements. In addition, assuming beam steering is in the antenna E-plane, where the E-plane is relatively narrow and the H-plane is relatively broad, the antenna element distance can be minimized while still covering a large solid angle. Additionally, as illustrated in FIG. 2, the first antenna 112, the second antenna 114, and the third antenna 116 are all positioned on the left side 218 of the substrate 216. Furthermore, the fourth antenna 116', the fifth antenna 114', and the sixth antenna 112' are all positioned on the right side 220 of the substrate 216.

The design is characterized by the absence of any constraint in the distance between adjacent elements, which allows the antennas to be placed in such a way that ensures low mutual coupling and reduces the spurious lobes that affect the radiation patterns.

In some embodiments, for example without limitation, as illustrated in FIG. 2, a first distance 202 between the first antenna 112 and a side of the substrate 216 is about 9.4 mm, a second distance 204 between the first antenna 112 and the second antenna 114 is about 15 mm, a third distance 206 between the second antenna 114 and the third antenna 116 is about 5 mm, and a fourth distance 208 between the third antenna 116 and the fourth antenna 116' is about 11.2 mm. Similarly, distances between the fourth antenna 116', the fifth antenna 114', the sixth antenna 112', and the right side 220 of the substrate 216 are about the same as those listed above for the right side 220 of the substrate 216. A width 210 of the substrate 216 in some embodiments is 70 mm and a length 214 of the substrate 216 plus the clearance 212 is 130 mm. In the example embodiment disclosed in FIG. 2, the clearance 212 is about 10 mm, making the length of the substrate 216 120 mm. In some embodiments, the dimensions listed above can be larger or smaller, depending on the needs of the device.

In order to cover a surface of 180°, in some embodiments, first antenna 112 has an inclination of 15°, second antenna 114 has an inclination of 45°, third antenna 116 has an inclination of 75°, fourth antenna 116' has an inclination of 75° in the opposite direction as the inclination of the third antenna 116, fifth antenna 114' has an inclination of 45° in the opposite direction as the inclination of the second antenna 114, and the sixth antenna 112' has an inclination of 15° in the opposite direction as the inclination of the first antenna 112.

In the first stage of the design for the embodiment described in FIG. 2, the printed circuit board (PCB) chosen was, for example and without limitation, a Rogers RT5880 with the following characteristics:

Epsilon: 2.2
Tangent delta: 0.0009 @ 10 GHz
Thickness: 0.381 mm
Metal thickness: 0.03 mm
Microstrip feed width: 1.2 mm
Microstrip feed length: 15 mm
Microstrip section width: 1 mm
Microstrip section length: 2.6 mm
Transmission line width: 0.4 mm
Driving dipole width: 0.4 mm
Driving dipole length: 4.4 mm
Directors width: 0.4 mm
Directors length: 3.2 mm
Director-to-director spacing: 2.3 mm In some embodiments, it is envisioned that the simulation could be performed by any number of suitable substrates with different characteristics than the ones listed above. Additionally, it is envisioned that in some embodiments, the antenna system can be incorporated into a working mobile device, such as, for example without limitation, a mobile phone, tablet, personal digital assistant (PDA), or other suitable mobile device.

Figure 3A:
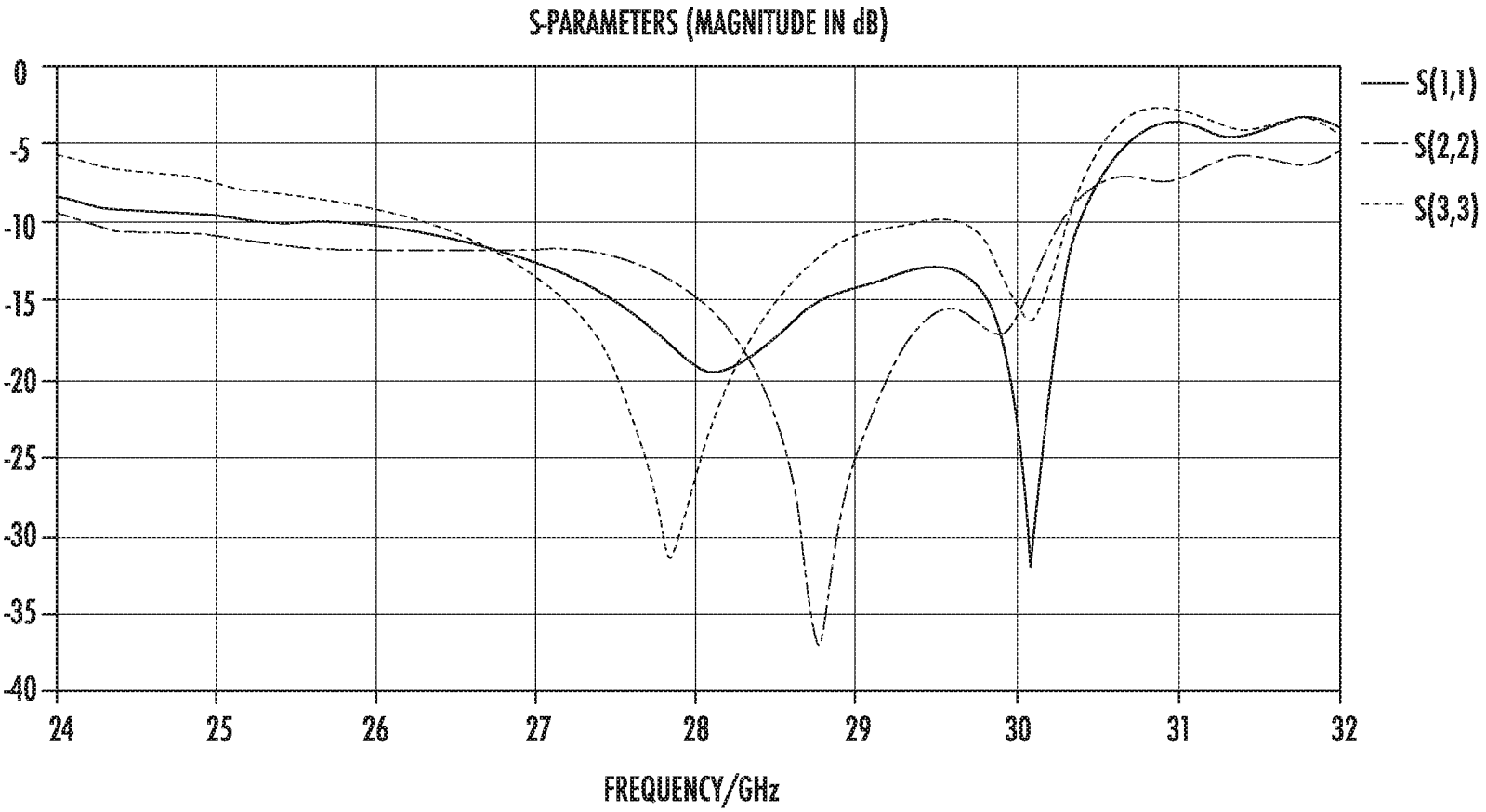
FIGS. 3A-3B are graphs illustrating the results of the simulated antenna system including the S-parameters.
Figure 3B:
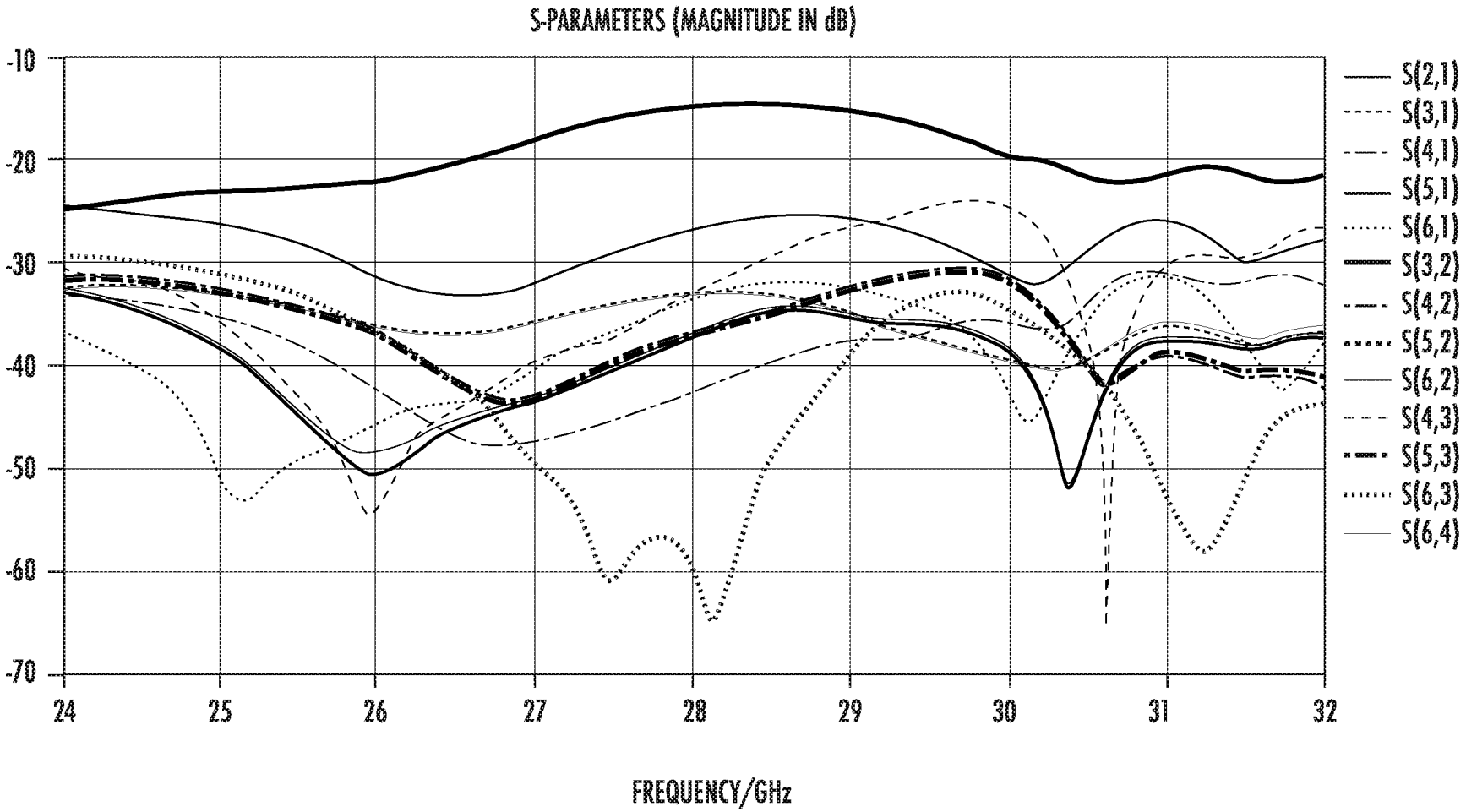

FIGS. 3A-3B illustrate the results of the example simulated antenna system 200. FIG. 3A illustrates the S-parameters of the simulated antenna system 200 in a return loss plot. FIG. 3B shows a mutual coupling plot.

In this example simulated antenna system 200 the six antennas (three on each side of the substrate 216) are adapted in the interval between about 26 GHz and 30 GHz. As seen in FIG. 3B, the value of the mutual coupling is below −20 dB, apart from S3,2, which has a mutual coupling value above −20 dB due to the very short distance between the second antenna 114 and the third antenna 116 (the same considerations apply for the fourth antenna 116' and the fifth antenna 114').

Figure 4:
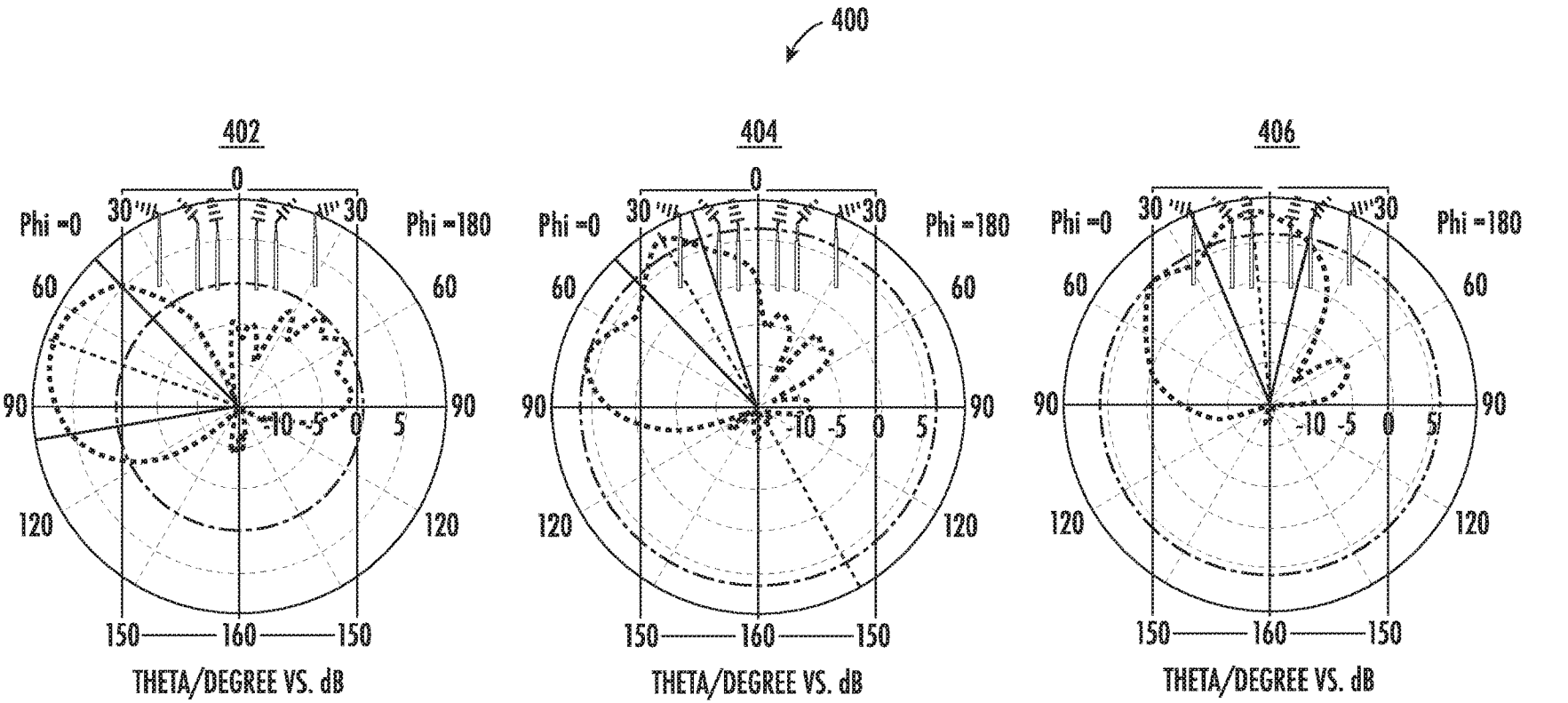
FIG. 4 includes plots illustrating analyses of the farfield of the antennas at 28 GHz.

FIG. 4 illustrates plots 400 of the farfield of three of the antennas, the first antenna 112, the second antenna 114, and the third antenna 116. Analyzing the farfield of the three antennas at 28 GHz, the following conclusions can be drawn from the plots 400. The first plot 402, illustrating the farfield at 28 GHz of the first antenna 112, inclined at 15°, shows the main lobe of the first antenna 112 pointing in the direction of the 60°-90° range on the first plot 402. The second plot 404, illustrating the farfield at 28 GHz of the second antenna 114, inclined at 45°, shows the main lobe of the second antenna 114 pointing in the direction of the 30°-60° range on the second plot 404. The third plot 406, illustrating the farfield at 28 GHz of the third antenna 116, inclined at 75°, shows the main lobe of the third antenna 116 pointing in the direction of the 0°-30° range on the third plot 406. The average main lobe magnitude of each of the plots 400 is about 8.5 dB. In some embodiments, the beamwidth can be adjusted by modifications to the design of the antennas. Further results of the example simulated antenna system 200 show a high gain (8 dB on average) in the whole working band of between about 26 GHz and 30 GHz.

In some embodiments, the example simulated antenna system 200 can have a reduced clearance of about 5 mm instead of 10 mm. This would make the example simulated antenna system 200 fit better inside of a 5G mobile device in the future. Moreover, embodiments of mobile devices comprising a reduced clearance of about 5 mm and an antenna system consistent with the present subject matter disclosed hereinabove is within the scope of the subject matter disclosed herein.

Furthermore, in some embodiments without limitation, the thickness of the substrate 216 can be increased in order to reduce the beamwidth and increase the gain of the simulated antenna system 200. Moreover, isolation can be introduced between the antennas for reducing the mutual coupling, for example without limitation, a metal strip can be inserted between two antennas.

Figure 5:
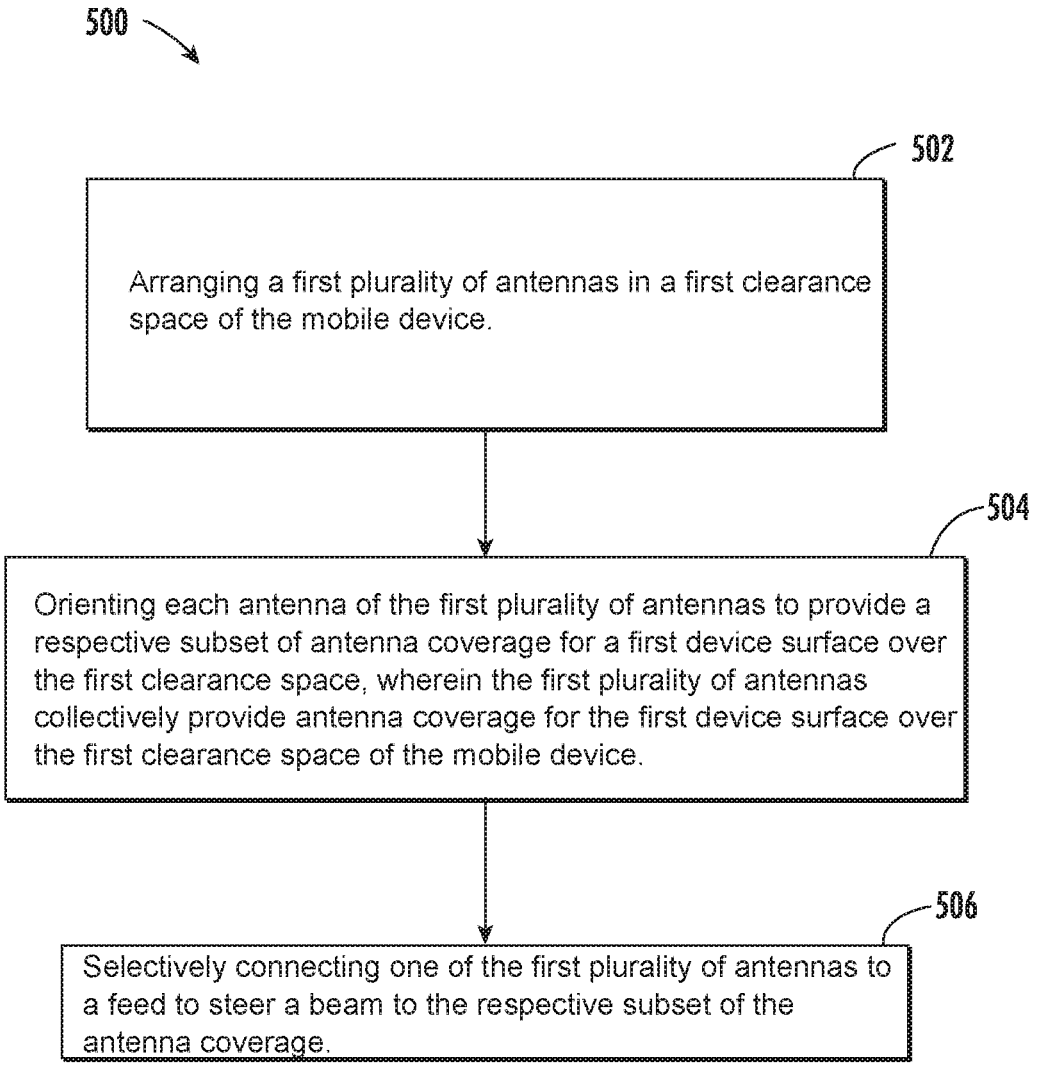
FIG. 5 is a flow diagram of an example method for producing and operating a mobile device according to one embodiment of the present disclosure.

FIG. 5 is a flow diagram of an example method 500 for producing and operating a mobile device. Step one 502 of the method 500 comprises arranging a first plurality of antennas in a first clearance space of the mobile device. Step two 504 of the method 500 comprises orienting each antenna of the first plurality of antennas to provide a respective subset of antenna coverage for a first device surface over the first clearance space, wherein the first plurality of antennas is configured to collectively provide antenna coverage for the first device surface over the first clearance space of the mobile device. The method 500 further comprises a third step 506, including selectively connecting one of the first plurality of antennas to a feed to steer a beam to the respective subset of the antenna coverage.

In some embodiments, for example and without limitation, the first set of antennas is mounted in an order from a first longitudinal surface of the mobile device 100 to a longitudinal center line of the mobile device 100. The second set of antennas are mounted in the same order from a second longitudinal surface, opposite the first longitudinal surface, to the longitudinal center line, such that the second set of antennas is arranged substantially symmetrically to the first set of antennas.

Figure 6:
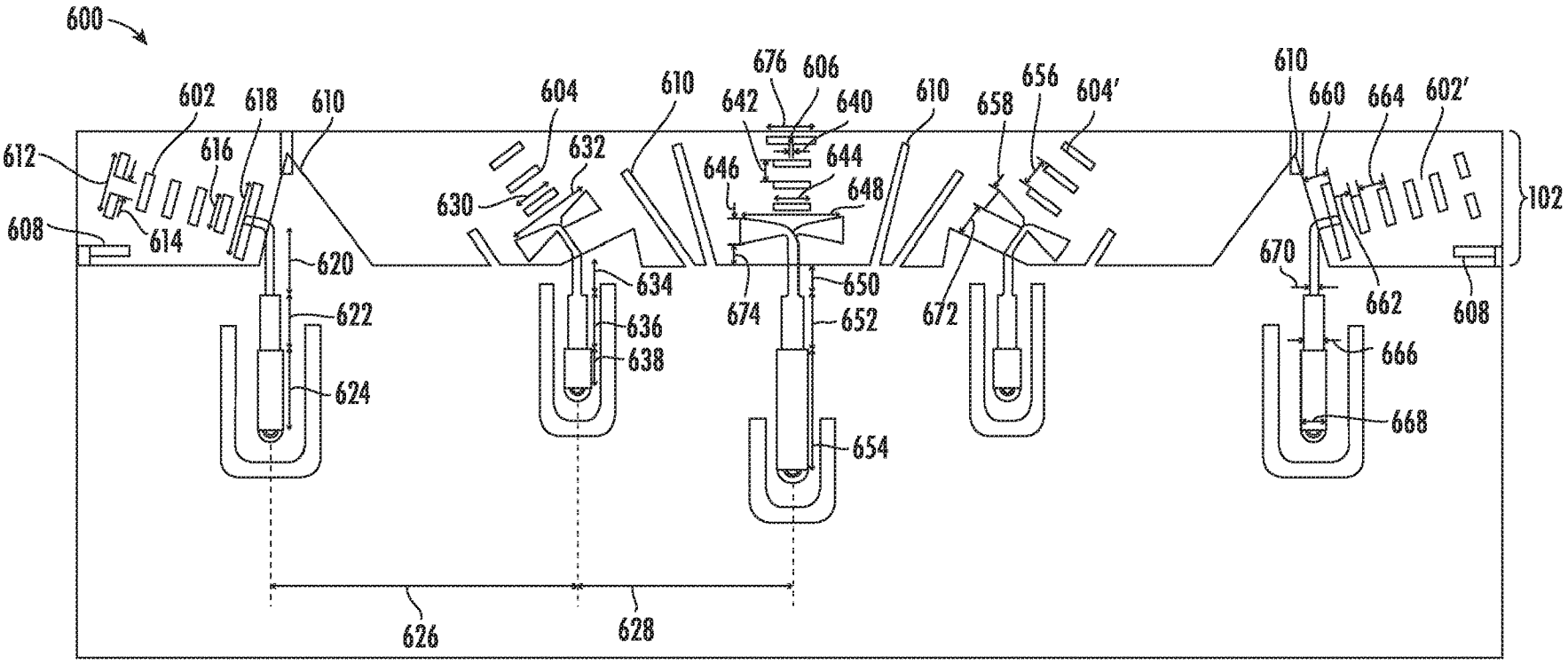
FIG. 6 illustrates a second simulated antenna system on a substrate.

FIG. 6 illustrates a second example simulated antenna system 600 comprising five antennas, seventh antenna 602, eighth antenna 604, ninth antenna 606, tenth antenna 604', and eleventh antenna 602'. In the second example simulated antenna system 600, the PCB chosen was, for example and without limitation, a Rogers RO3003 substrate with an epsilon of 3, a length of 130 mm, a width of 70 mm, and a thickness of 0.762 mm. In some embodiments the seventh antenna 602, eighth antenna 604, ninth antenna 606, tenth antenna 604', and eleventh antenna 602' can be positioned in the upper edge and in the clearance 102 of a mobile device in a substantially symmetrical manner. In some embodiments, each of the five antennas is fed by a microstrip and is a Quasi-Yagi antenna. Furthermore, in the second example simulated antenna system 600, the antennas occupy a clearance of only 6.5 mm. In some embodiments, each of the five antennas, seventh antenna 602, eighth antenna 604, ninth antenna 606, tenth antenna 604', and eleventh antenna 602', has a 40° beamwidth, scanning different parts of the space.

In some embodiments, to achieve the desired coverage, the seventh antenna 602 and the eleventh antenna 602' have a 15° inclination pointing to the left and right side of the area respectively. In some embodiments, the eighth antenna 604 and the tenth antenna 604' have a 55° inclination, covering the upper left and upper right part of the area, respectively. Finally, in some embodiments, the ninth antenna 606 has an inclination of 90°, which allows it to scan the top of the area. In some embodiments, the truncated ground plane acts as a reflector to maximize the antenna gain. In some embodiments, two symmetric extended stubs 608 can be added in order to direct the beams of the antennas better. Additionally, in some embodiments, directors 610 can be added to the antenna system, printed on both sides of the substrate in order to maximize the beam directivity. In some embodiments, the directors 610 can be ladder-like directors configured to enhance the gain of the antennas and the bandwidth. In some embodiments, the directors 610 are formed from extensions of the ground plane. The directors 610 modify the near field to improve the directivity and gain of each directional antenna. They also reduce the coupling between adjacent antenna elements and thus improve the isolation between elements. This further improves gain and reduces parasitic resonance effects. In some embodiments, the eighth antenna 604, and ninth antenna 606, and the tenth antenna 604' present a bowtie driver that is configured to improve the bandwidth. The driving dipoles are printed symmetrically on both faces of the substrate. In particular, a half dipole, placed in the bottom of the mobile device, is grounded in the antenna ground plane and a half dipole on top is connected to a microstrip line fed by an mmpx connected (not shown).

In some embodiments, the second example simulated antenna system 600 has the following dimensions: a fifth distance 626 of about 15 mm, a sixth distance 628 of about 10.6 mm, a seventh distance 620 of about 3.2 mm, an eighth distance 622 of about 2.6 mm, a ninth distance 624 of about 4 mm, a tenth distance 634 of about 1.6 mm, an eleventh distance 636 of about 2.5 mm, a twelfth distance 638 of about 2 mm, a thirteenth distance 650 of about 1.4 mm, a fourteenth distance 652 of about 2.5 mm, a fifteenth distance 654 of about 6 mm, a sixteenth distance 618 of about 3.8 mm, a seventeenth distance 616 of about 1.8 mm, an eighteenth distance 612 of about 3.08 mm, a nineteenth distance 614 of about 0.92 mm, a twentieth distance 664 of about 1.3 mm, a twenty-first distance 660 of about 1.2 mm, a twenty-second distance 632 of about 4.3 mm, a twenty-third distance 630 of about 1.9 mm, a twenty-fourth distance 656 of about 1.4 mm, a twenty-fifth distance 672 of about 1.7 mm, a twenty-sixth distance 648 of about 5 mm, a twenty-seventh distance 644 of about 1.8 mm, a twenty-eighth distance 676 of about 2.44 mm, a twenty-ninth distance 640 of about 0.1 mm, a thirtieth distance 642 of about 1.1 mm, and a thirty-first distance 674 of about 1.1 mm. Furthermore, in some embodiments, the second example simulated antenna system 600 has the following dimensions: first width 662 of about 0.4 mm, a second width 670 of about 0.4 mm, a third width 666 of about 1 mm, a fourth width 668 of about 1.2 mm, a fifth width 658 of about 1.2 mm, and a sixth width 646 of about 1.2 mm. The above dimensions are for non-limiting, example purposes only, disclosed herein to provide better context for the second example simulated antenna system 600. A hybrid high gain antenna system according to the present disclosure could feasibly be comprised of any suitable substrate or device with suitable dimensions.

Figure 7:
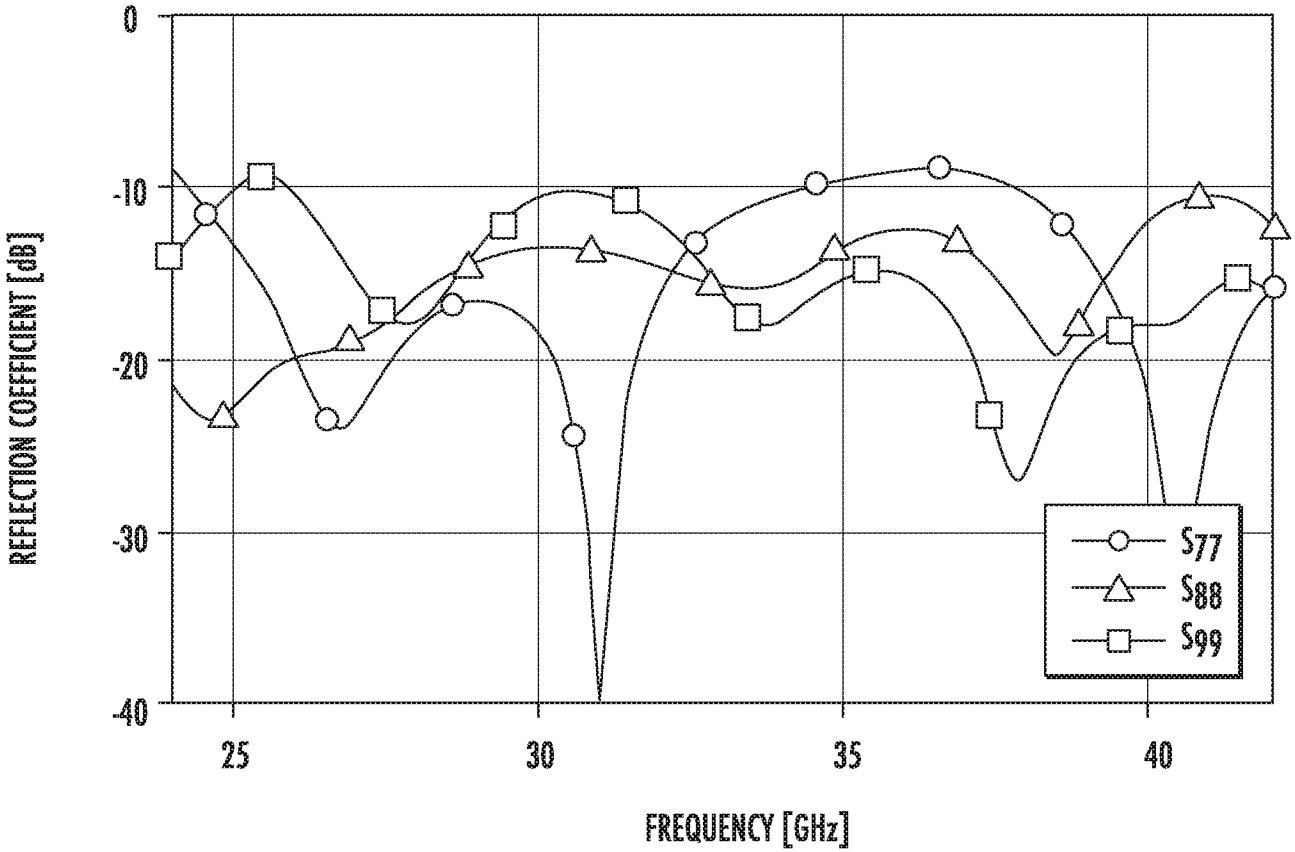
FIG. 7 includes a plot illustrating analyses of the return loss of the second simulated antenna system.
Figure 8:
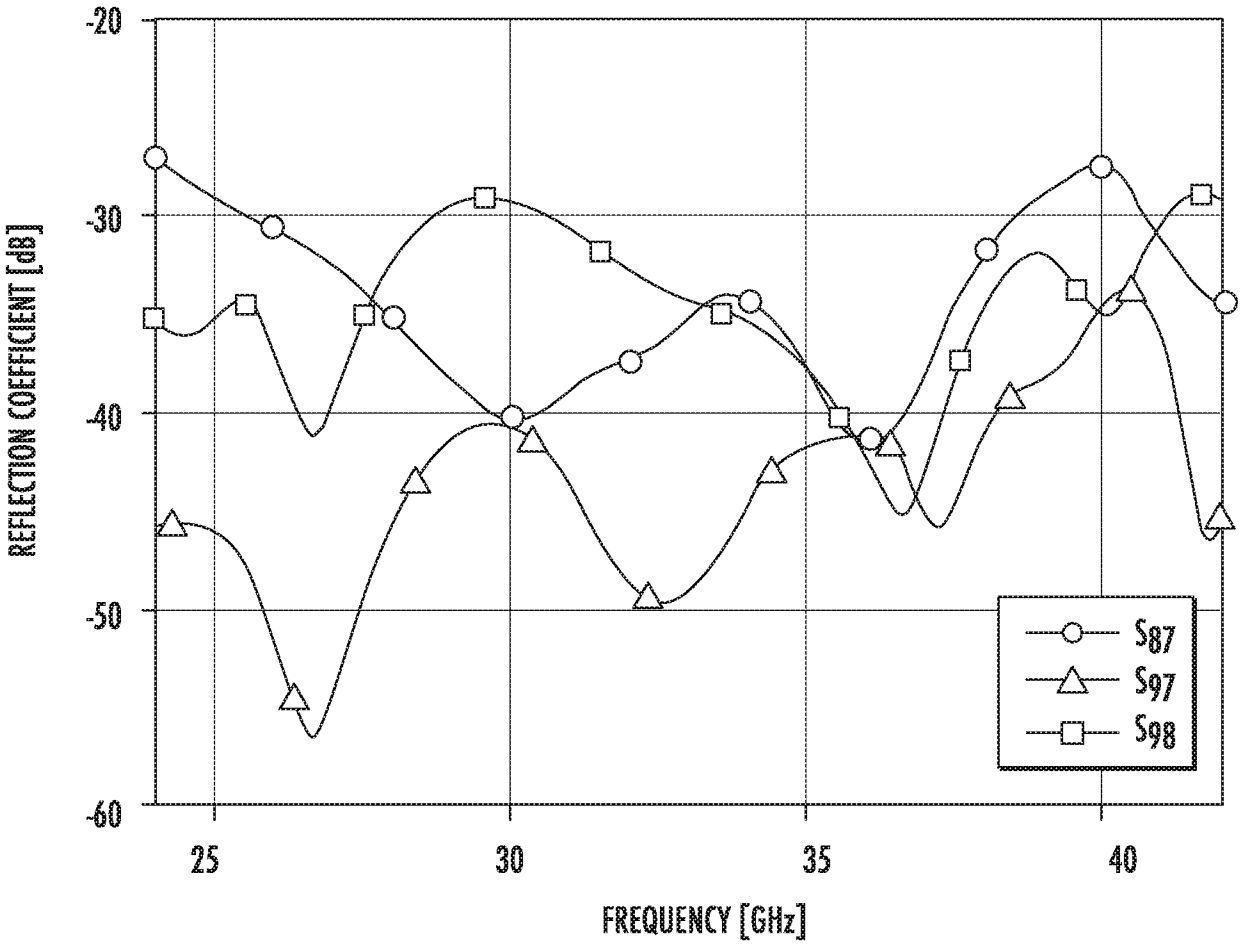
FIG. 8 includes a plot illustrating analyses of the mutual coupling of the second simulated antenna system.
Figure 9:
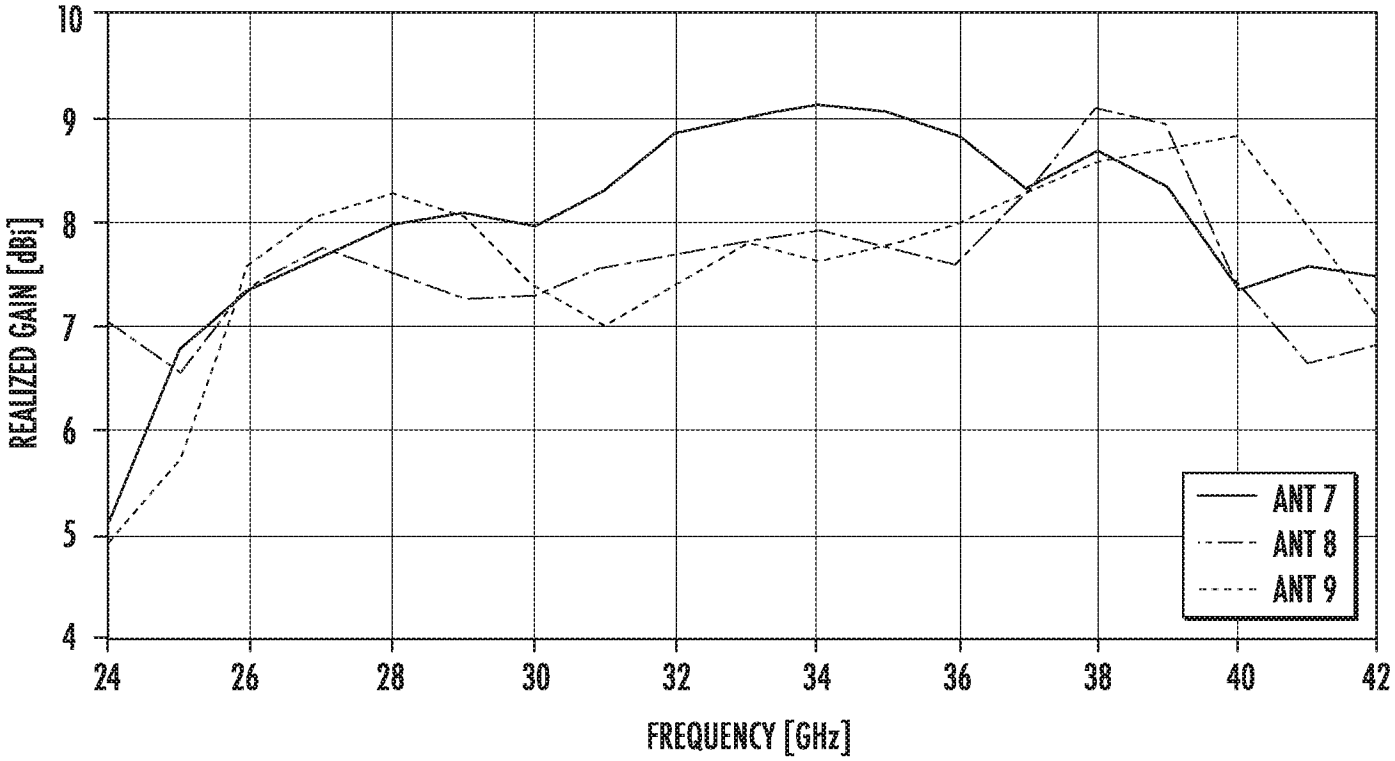
FIG. 9 includes a plot illustrating the realized gain in dBi of each antenna element.

FIG. 7 illustrates a plot indicating the whole system covers a bandwidth of over 18 GHz in the band of about 28 GHz. Furthermore, FIG. 7 shows the simulated return loss of the second example simulated antenna system 600. In FIGS. 7-9, the plots for the tenth antenna 604' and the eleventh antenna 602' are similar to the plots for the eighth antenna 604 and the seventh antenna 602 respectively, and are thus not shown. FIG. 8 illustrates that the isolation between neighboring antennas is below about 20 dB. FIG. 9 illustrates that in accordance with the requirements approved by the 3GPP standard, the realized gain of each antenna component is higher than about 7 dBi in the band 26-40 GHz, with peak gain values at about 28 GHz and about 38 GHz.

Figure 10:
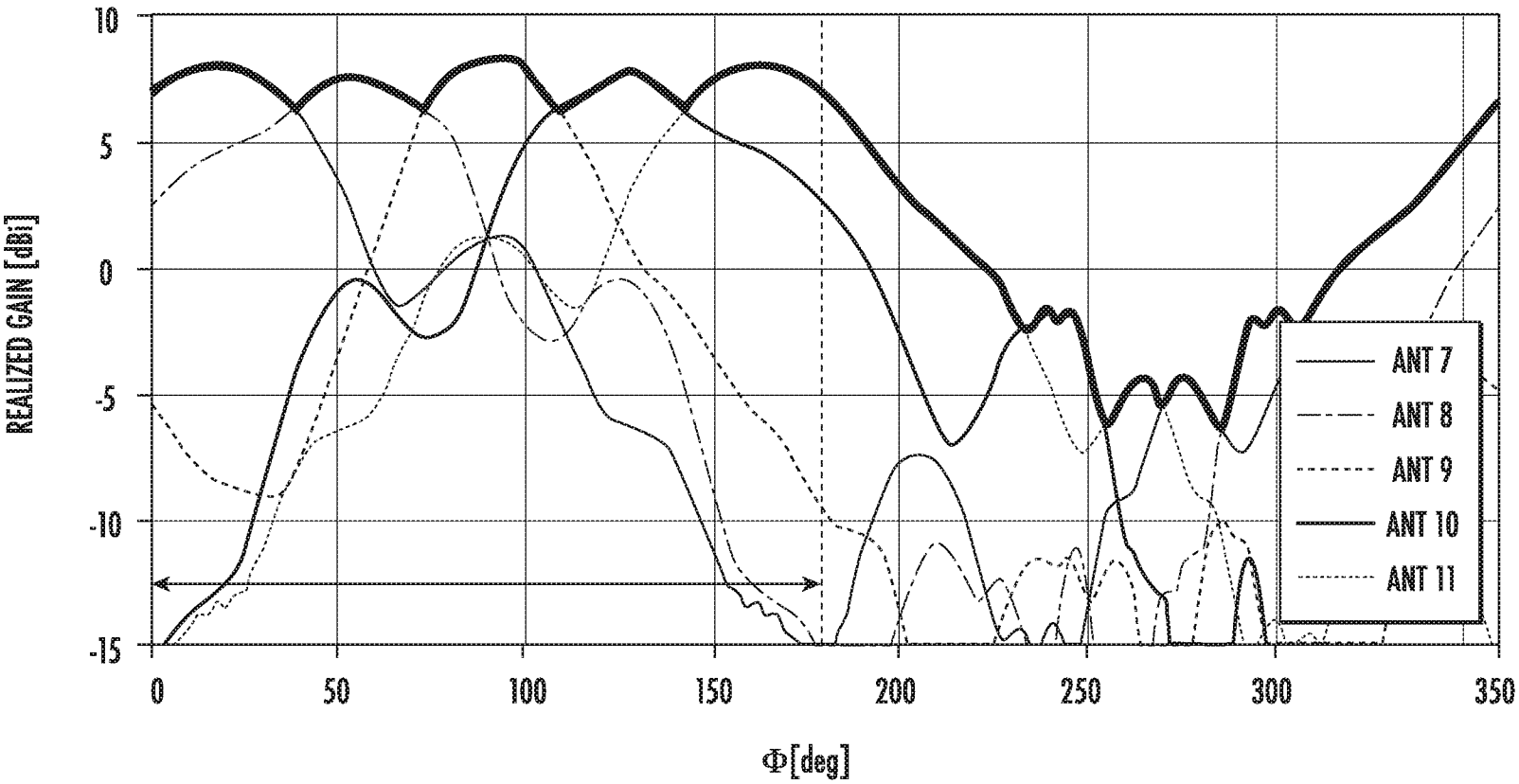
FIG. 10 includes a plot illustrating the realized gain characteristics of the second simulated antenna system at 28 GHz.
Figure 11:
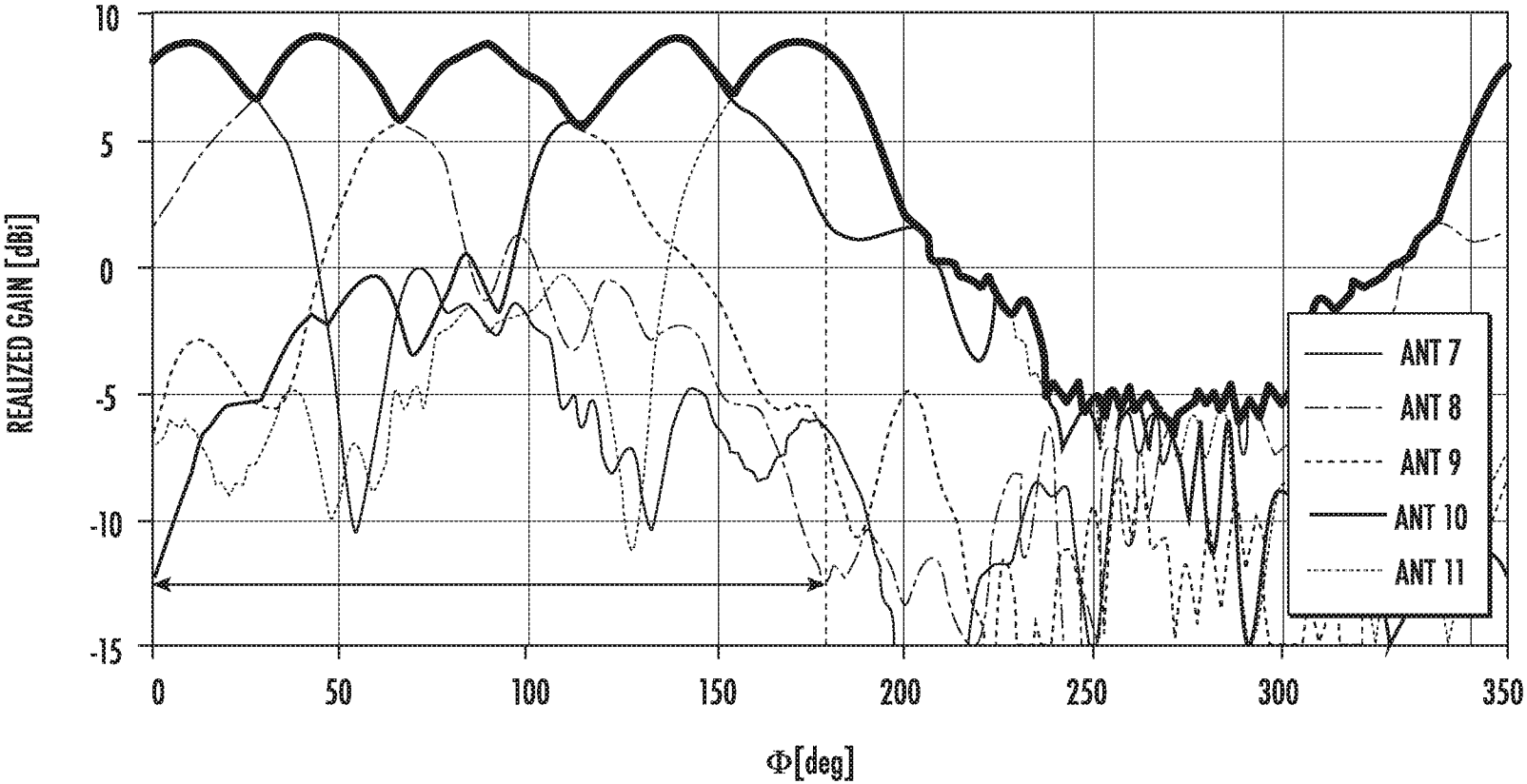
FIG. 11 includes a plot illustrating the realized gain characteristics of the second simulated antenna system at 38 GHz.

FIG. 10 illustrates the three-dimensional (3-D) coverage of the antenna systems for the selected frequencies. The plot in FIG. 10 represents the envelope at about 28 GHz shows that it is possible to cover an area of about 180° with a maximum gain of about 8 dBi. In particular, each antenna is able to steer about 40° beamwidth on average. FIG. 11 illustrates a plot reproducing the coverage at 38 GHz showing that the beamwidth of each antenna element is slightly narrower with consequently higher peak gain of about 9 dBi.

In an alternative configuration, rather than the antenna elements being arranged in a substantially linear configuration to provide 180° of antenna coverage from an end of the mobile device 100, similar principles can be applied to groups of antenna elements at different positions on the mobile device 100. For example, in some embodiments, a first plurality of antennas can be mounted along a first edge of the mobile device 100 approaching a corner of the mobile device 100, and a second plurality of antennas can be mounted along a second edge of the mobile device 100 approaching the same corner. In this arrangement, each antenna element provides a respective subset of antenna coverage for the mobile device 100 about the corner. In some embodiments, such an arrangement can be configured to provide 90° of antenna coverage at each corner. In some embodiments, antenna systems like those described herein above can be arranged, for example without limitation, symmetrically or non-symmetrically in a first clearance space under a first surface of a first end of a mobile device 100 and/or in a second clearance space under a second surface of a second end of the mobile device 100.

In any configuration, in some embodiments, multiple element antenna systems can be positioned about the edges of a mobile device 100. For example and without limitation, four hybrid antenna systems can be utilized, with one antenna system positioned on each edge or each corner of the mobile device 100, and the coverage area of each antenna system can be designed to at least partially overlap with the coverage of adjacent antenna system. In this way, the present systems can be useful for multiple-input/multiple-output (MIMO) applications and/or for combatting user effects.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A mobile device comprising:

a first plurality of antennas in a first clearance space of the mobile device, wherein each antenna of the first plurality of antennas is oriented to provide a respective subset of antenna coverage for a first device surface over the first clearance space;

wherein the first plurality of antennas is configured to collectively provide antenna coverage for the first device surface over the first clearance space of the mobile device; and wherein a difference in an angle of inclination between adjacent antennas is approximately equal to a beamwidth of at least one of the first plurality of antennas.

2. The mobile device of claim 1, wherein the first plurality of antennas is disposed substantially symmetrically with respect to a longitudinal center line of the mobile device, and either:

the first plurality of antennas comprises an odd number of antennas and a single antenna is on the longitudinal center line; or the first plurality of antennas comprises an even number of antennas.

3. The mobile device of claim 1, wherein each antenna of the first plurality of antennas is configured, by virtue of having a respective beamwidth and orientation, to provide a subset of approximately 180° of antenna coverage for the first device surface over the first clearance space.

4. The mobile device of claim 3, wherein the first plurality of antennas collectively provide approximately 180° of antenna coverage for the first device surface over the first clearance space of the mobile device.

5. The mobile device of claim 1, wherein the first plurality of antennas comprises six antennas, each having an approximately 30° beamwidth.

6. The mobile device of claim 5, wherein each antenna of a first pair of antennas of the six antennas has an approximately 15° inclination, wherein a direction of inclination of each antenna of the first pair of antennas is an approximately opposite direction of inclination with respect to one another;

wherein each antenna of a second pair of antennas of the six antennas has an approximately 45° inclination wherein a direction of inclination of each antenna of the second pair of antennas is an approximately opposite direction of inclination with respect to one another; and wherein each antenna of a third pair of antennas of the six antennas has an approximately 75° inclination wherein a direction of inclination of each antenna of the third pair of antennas is an approximately opposite direction of inclination with respect to one another.

7. The mobile device of claim 1, wherein each of the first plurality of antennas is configured to reach a gain of between about 10 dBi and 12 dBi at a target frequency.

8. The mobile device of claim 7, wherein the target frequency is between about 26 GHz and 30 GHz.

9. The mobile device of claim 1, wherein each of the first plurality of antennas is a high gain Quasi-Yagi antenna.

10. The mobile device of claim 1, wherein the first clearance space has a lateral length of about 10 mm or less.

11. The mobile device of claim 1, wherein the first clearance space has a lateral length of about 5 mm or less.

12. The mobile device of claim 1, wherein the mobile device is configured to independently drive each of the first plurality of antennas.

13. The mobile device of claim 1, wherein the mobile device further comprises a switch configured to switch a radio feed between each of the first plurality of antennas.

14. The mobile device of claim 1 comprising the first plurality of antennas on a first end of the mobile device and a second plurality of antennas on a second end of the mobile device;

wherein each antenna of the second plurality of antennas is oriented to provide a respective subset of antenna coverage for a second device surface over a second clearance space; and wherein the second plurality of antennas is configured to collectively provide antenna coverage for the second device surface over the second clearance space of the mobile device.

15. The mobile device of claim 1 further comprising directors configured to maximize a beam directivity of each antenna of the first plurality of antennas.

16. A method for producing a mobile device comprising:

arranging a first plurality of antennas in a first clearance space of the mobile device;

orienting each antenna of the first plurality of antennas to provide a respective subset of antenna coverage for a first device surface over the first clearance space, wherein the first plurality of antennas collectively provide antenna coverage for the first device surface over the first clearance space of the mobile device; and selectively connecting one of the first plurality of antennas to a feed to steer a beam to the respective subset of the antenna coverage;

wherein a difference in an angle of inclination between adjacent antennas is approximately equal to a beamwidth of at least one of the first plurality of antennas.

17. The method of claim 16, wherein the first plurality of antennas comprises an odd number of antennas and a single antenna is on a longitudinal center line of the mobile device.

18. The method of claim 16, wherein each antenna of the first plurality of antennas is configured, by virtue of having a respective beamwidth and orientation, to provide a subset of approximately 180° of antenna coverage for the first device surface over the first clearance space.

19. The method of claim 18, wherein the first plurality of antennas collectively provide approximately 180° of antenna coverage for the first device surface over the first clearance space of the mobile device.

20. The method of claim 16, wherein the first plurality of antennas comprises six antennas, each having an approximately 30° beamwidth.

21. The method of claim 20, wherein each antenna of a first pair of antennas of the six antennas has an approximately 15° inclination, wherein a direction of inclination of each antenna of the first pair of antennas is an approximately opposite direction of inclination with respect to one another;

wherein each antenna of a second pair of antennas of the six antennas has an approximately 45° inclination wherein a direction of inclination of each antenna of the second pair of antennas is an approximately opposite direction of inclination with respect to one another; and wherein each antenna of a third pair of antennas of the six antennas has an approximately 75° inclination wherein a direction of inclination of each antenna of the third pair of antennas is an approximately opposite direction of inclination with respect to one another.

22. The method of claim 16, wherein each of the first plurality of antennas is configured to reach a gain of between about 10 dBi and 12 dBi at a target frequency.

23. The method of claim 22, wherein the target frequency is between about 26 GHz and 30 GHz.

24. The method of claim 16, wherein each of the first plurality of antennas is a high gain Quasi-Yagi antenna.

25. The method of claim 16, wherein the first clearance space has a lateral length of about 10 mm or less.

26. The method of claim 16, wherein the first clearance space has a lateral length of about 5 mm or less.

27. The method of claim 16, wherein the mobile device is configured to independently drive each of the first plurality of antennas.

28. The method of claim 16, further comprising providing the mobile device with a switch configured to switch a radio feed between each of the first plurality of antennas.

29. The method of claim 16 further comprising:

arranging the first plurality of antennas on a first end of the mobile device and a second plurality of antennas on a second end of the mobile device;

wherein each antenna of the second plurality of antennas is oriented to provide a respective subset of antenna coverage for a second device surface over a second clearance space; and wherein the second plurality of antennas collectively provide antenna coverage for the second device surface over the second clearance space of the mobile device.

30. The method of claim 16 further comprising providing the mobile device with directors configured to maximize a beam directivity of each antenna of the first plurality of antennas.

31. An antenna system comprising:

a plurality of antennas under a surface, wherein each antenna of the plurality of antennas is oriented to provide a respective subset of antenna coverage for the surface over a clearance space;

wherein the plurality of antennas is configured to collectively provide antenna coverage for the surface over the clearance space; and wherein a difference in an angle of inclination between adjacent antennas is approximately equal to a beamwidth of at least one the first plurality of antennas.

32. The antenna system of claim 31, wherein the plurality of antennas is disposed substantially symmetrically with respect to a center line of the surface, and either:

the plurality of antennas comprises an odd number of antennas and a single antenna is on the center line; or the plurality of antennas comprises an even number of antennas.

* * * * *